United States Patent [19]

Brock

[11] 4,378,846

[45] Apr. 5, 1983

[54] ENHANCED OIL RECOVERY APPARATUS AND METHOD

[76] Inventor: Kurtis B. Brock, 6870 E. 11th St., Long Beach, Calif. 90815

[21] Appl. No.: 216,425

[22] Filed: Dec. 15, 1980

[51] Int. Cl.[3] ..... E21B 43/24

[52] U.S. Cl. ..... 166/303; 166/60; 219/278; 219/291

[58] Field of Search ..... 166/57, 60, 65 R, 272, 166/302, 303; 219/277, 278, 279, 291, 292, 293

[56] References Cited

U.S. PATENT DOCUMENTS

| | | | |
|---|---|---|---|
| 678,782 | 7/1901 | Hill | 219/291 |
| 1,433,956 | 10/1922 | Knox | 166/267 |
| 2,076,669 | 4/1937 | Redfield et al. | 219/277 |
| 2,639,774 | 5/1953 | Rhoads | 166/57 |
| 2,670,802 | 3/1954 | Ackley | 166/60 X |
| 3,163,745 | 12/1964 | Boston | 166/272 X |
| 3,213,942 | 10/1965 | Nixon | 166/60 |
| 3,349,850 | 10/1967 | Schlicht et al. | 166/303 |
| 3,371,713 | 3/1968 | Silverman | 166/303 X |
| 3,420,301 | 1/1969 | Riley et al. | 166/60 |
| 3,498,381 | 3/1970 | Earlougher, Jr. | 166/57 X |
| 3,500,910 | 3/1970 | Triplett et al. | 166/272 X |
| 3,614,986 | 10/1971 | Gill | 166/60 X |
| 4,185,691 | 1/1980 | Tubin | 166/60 |
| 4,266,116 | 5/1981 | Bauer et al. | 219/291 |

FOREIGN PATENT DOCUMENTS

| | | | |
|---|---|---|---|
| 588349 | 1/1978 | U.S.S.R. | 166/57 |

*Primary Examiner*—James A. Leppink
*Assistant Examiner*—George A. Suchfield
*Attorney, Agent, or Firm*—Matthew L. Ajeman

[57] ABSTRACT

Apparatus for heating hydrocarbons, and the like, in an underground reservoir for the purpose of lowering the viscosity of the substance in the reservoir and facilitating the flow thereof has a flow channel arrangement disposable in a reservoir of the material to be treated for forming a flow path for a working fluid that is heated by a heating system associated with the flow channel arrangement. The heated working fluid is then discharged from the flow path and into the reservoir of material to be heated for the purpose of lowering the viscosity and improving the flowability of the material in the reservoir.

The heating system includes an electrical resistance heating unit comprising an electrical circuit including at least one pair of opposed electrodes electrically connected in series and arranged along and partially forming the flow path for the working fluid, with the portion of the electrical circuit between the electrodes being completed through the working fluid. The series connection of the electrodes provide for efficient downhole use of electrical energy even at depths below 2,000 feet, by minimizing line losses to the electrodes and by creating, with accurate control, a very high resistance at the bottom of the well in which the device is disposed.

7 Claims, 3 Drawing Figures

ENHANCED OIL RECOVERY APPARATUS AND METHOD

BACKGROUND OF THE INVENTION

1. Field of the Invention

This invention relates generally to the recovery of hydrocarbons from underground reservoirs, and particularly to the recovery of highly viscous oil and other hydrocarbons that resist flow under normal conditions of temperature and pressure.

2. Description of the Prior Art

The demand for new sources of hydrocarbon fuels, particularly petroleum together with an increase in the price receivable for domestically produced oil, has created renewed interest in increased production of highly viscous petroleum reserves. These reserves make up a substantial portion of the petroleum reserves in the United States.

By "highly viscous" petroleum is meant one having a gravity of 20 or less on the American Petroleum Institute (API) density scale, with lighter crude oils carrying higher numbers than heavier crudes. For example, a typical light density crude may have an API rating of 37 or higher.

A problem with the recovery of these heavy crudes, however, is that the viscosity of the oil, or other hydrocarbon, is so great that the crudes does not tend to flow. Many of these crudes, having API numbers for example, 13 or 14, are essentially tar-like substances. Several systems usually referred to as enhanced recovery techniques, have been proposed for heating the crude while still underground in order to lower the viscosity of the oil and facilitate pumping thereof to the surface below which the reservoir of crude is located. One of the most commonly used process for recovering heavy crude involves injecting steam produced by surface generators into the underground reservoir in order to heat the oil and simultaneously push the crude toward recovery wells disposed near the injection well. This process, sometimes referred to as "steam stimulation", involves locating a steam injection well centrally of, for example, four production wells arranged on a rectangular grid. This process has encountered two basic problems, especially when used to recover oil from pools located at extreme depths-usually well below 2,000 feet. Firstly, the steam generators, which must necessarily be located in the vicinity of the injection wells, create environmental pollution problems. Secondly, the steam cools and liquifies as it proceeds down the base of an injection well, thus effectively limiting the well depths with which the system can be used effectively.

U.S. Pat. No. 3,420,301, issued Jan. 7, 1969 to O. L. Riley, et al, disclosed an apparatus for heating and recovering underground oil. This known apparatus employs a pair of hollow cylindrical concentrically arranged electrodes electrically connected in parallel for the purpose of heating the petroleum by use of a unit containing the electrodes and adapted to be situated in a dielectrically insulated borehole adjacent an oil-bearing formation. The heating unit is capable of allowing water, hot or cold, to be pumped into the oil-bearing formation for changing the viscosity of the oil and having further a capability inherent therein for retrieving the lower viscosity oil. While this prior art device has the advantage of eliminating the necessity for surface steam generators, it is handicapped by being useful for recovering hydrocarbons from only comparatively shallow depths of, typically, 2,000 feet or less, at which limit the cost of supplying electrical energy to the electrodes becomes prohibitive due to inherent inefficiencies in the possible connection of the electrodes and to downhole losses in the leads to the electrodes. These disadvantages of the system employed by this known device result in the operational efficiency of the system being relatively low, especially at greater depths, with 60% to 70% of the BTV input to the system being lost.

U.S. Pat. No. 3,213,942, issued Oct. 26, 1965 to D. C. Nixon, discloses apparatus for removing paraffin buildup in production tubing of oil wells. More specifically, a plurality of arcuate electrodes are arranged in longitudinally spaced relation along a wall of the tubing and are connected to one of an electrical source and electrical ground for causing a current flow through its oil. But, these electrodes, like those in U.S. Pat. No. 3,420,301, discussed above, are connected together in parallel and suffer the same limitations. Further, U.S. Pat. No. 2,350,429, issued June 6, 1944, to D. F. Troupe, discloses a downwell heater in which an electrolyte is heated by passing an electrical current through it from spaced electrodes.

Once again, however, the electrodes are connected in parallel, as they are in the two U.S. Patents discussed above.

Finally, U.S. Pat. No. 2,430,347, issued Nov. 4, 1947, to W. C. Lamphier, discloses a steam generator device in which a current is passed between spaced electrodes for flash vaporizing a liquid disposed between the electrodes. But, like the devices discussed above, this known steam generating device uses electrodes connected in parallel, and therefore would suffer from the same disadvantages as the other devices discussed above if disposed downhole in order to create steam for the purpose of lowering the viscosity of heavy crude.

U.S. Pat. No. 1,726,041, issued Aug. 27, 1929, to D. V. Powell, is mentioned as showing an oil field regenerating system being encased, parallel flat plate electrodes, while U.S. Pat. No. 2,932,352, issued Apr. 12, 1960 to R. J. Steyemeier, discloses a liquid filled well heater using a non-circulating heat conducting fluid. Again, the electrodes of these two devices are connected in parallel. U.S. Pat. No. 1,835,400, issued Dec. 8, 1931, to J. W. Ingeson, et al, discloses an oil well heater with an electrical, closed-circuit heated fluid system, with U.S. Pat. No. 1,464,618, issued Aug. 14, 1923, to R. S. Pershing, disclosing an electric heater for oil wells, and the like, having multiple electrical heating units. Finally, there is known a device as disclosed in U.S. Pat. No. 2,908,331, issued Oct. 13, 1959, to A. L. Brown, which employs a closed-circuit heater-fluid circulating system in an oil well heater. Most of these latter-mentioned devices have the disadvantage of being closed-circuit systems, which do not inject hot liquid or steam (vapor) into hydrocarbon reservoir directly, and these are not as efficient in energy transfer as are the steam injection arrangements.

SUMMARY OF THE INVENTION

It is an object of the present invention to provide an enhanced well recovery system which is more versitile and more energy efficient than known systems for the same purpose.

It is another object of the present invention to provide an enhanced recovery system which can be employed economically and effectively downhole in a well at depths in excess of 2,000 feet.

Still another object of the present invention is to provide an enhanced recovery system which makes efficient use of electrical energy, but which injects steam, or very hot liquid, directly into the reservoir of a heavy hydrocarbon substance whose viscosity is to be lowered in order to facilitate the recovery of the substance.

A still further object of the present invention is to provide an electrically actuated, down-well hydrocarbon recovery system which minimizes double electrical line hoses, while eliminating the need for insulating the base of the well.

These and other objects of the present invention are achieved by providing apparatus for heating hydrocarbons in an underground reservoir, comprising: a flow channel arrangement disposable in a reservoir of hydrocarbons for forming a flow path for a working fluid; and a heating system associated with the flow channel arrangement for heating the working fluid prior to discharging the working fluid from the flow path and into a reservoir of hydrocarbons to be heated.

The flow channel arrangement preferably includes a housing attachable to a pipe string and having an exterior and defining a hollow internal chamber. Arranged within the chamber and communicating with the exterior of the housing is a conduit forming the flow path for the working fluid. The conduit advantageously includes a fluid inlet to the chamber, a restricted fluid flow circuit through the chamber, and a fluid outlet from the chamber.

According to a preferred construction, the fluid inlet and the fluid outlet are respectively located in maximum distally spaced portions of the housing, with the fluid flow circuit of the conduit means forming a tortious path between the fluid inlet and fluid outlet and arrangeable relative to an associated pipe string to form three substantially parallel, vertically disposed legs. In an advantageous form of the fluid flow circuit, it is substantially "S" shaped when rotated from a vertical to horizontal orientation.

The heating system preferably includes an electrical resistance heating unit comprising a series electrical current including a pair of opposed electrodes arranged along and partially forming the flow path of a working fluid. Portions of the electrical circuit, namely those between the electrodes, are completed through the working fluid, making the working fluid itself the primary resistance in the circuit.

Advantageously, the pair of electrodes is one of a plurality of pair of opposed electrodes included in the electrical circuit and spaced along an upwardly directed portion of the flow path of the working fluid so as to assure complete filling of the leg of the conduit, each of the electrodes of the pairs being electrically connected in series with all of the other electrodes in the electrical circuit.

The housing, containing the heating system, is arrangeable in the bottom of a pipe string for being lowered to the bottom of a well. A working fluid, usually water, is passed down the pipe string and between the series connected electrodes of the heating system for being heated by the electrical current passing between the electrodes. The fluid thus heated, preferably flashed to steam, is then injected into a reservoir of hydrocarbons for lowering the viscosity of same.

DESCRIPTION OF THE PREFERRED EMBODIMENTS

Figure 1:
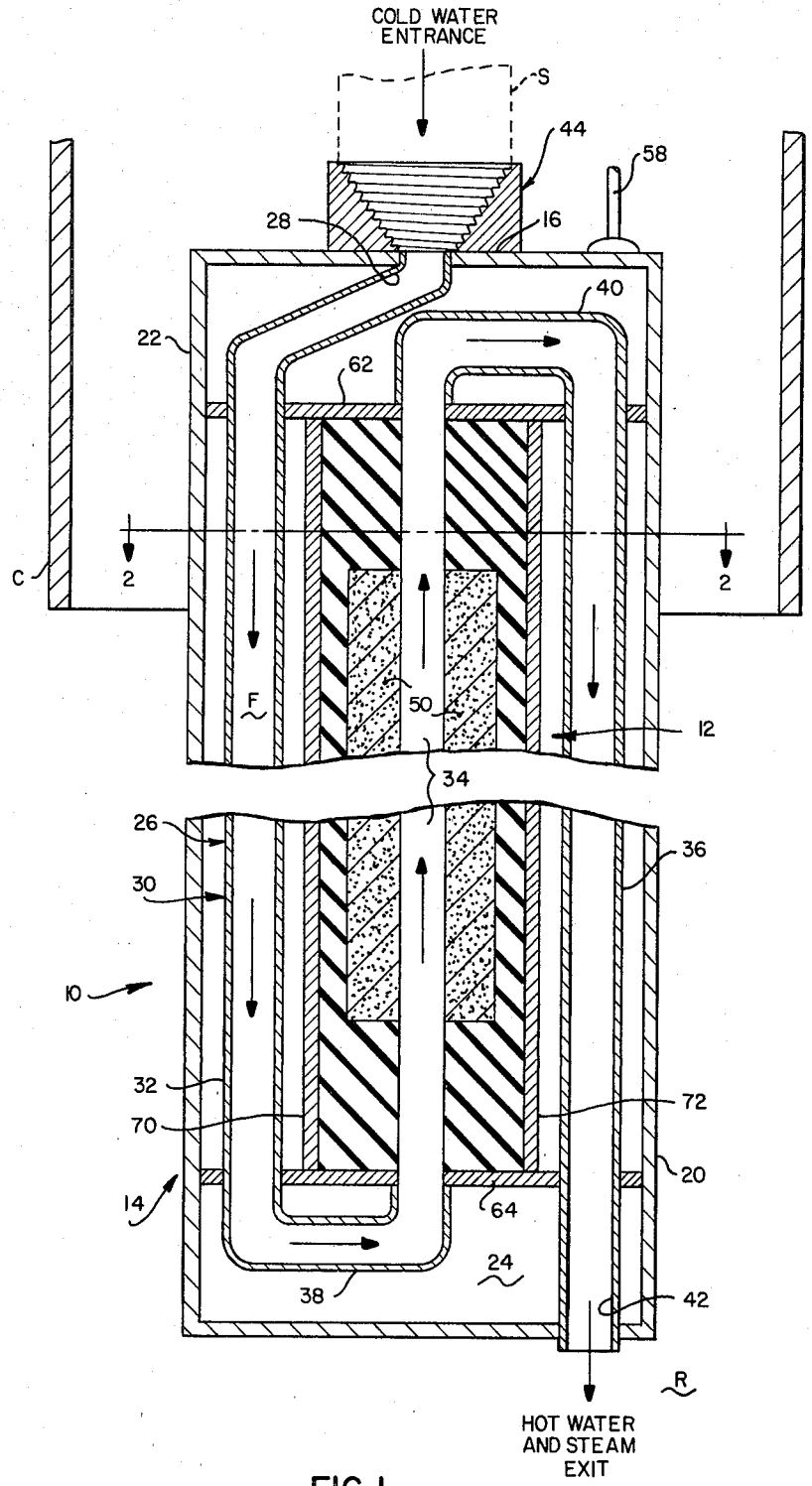
FIG. 1 is a diagrammatic, fragmentary, vertical longitudinal sectional view showing an enhanced recovery apparatus according to the present invention.
Figure 2:
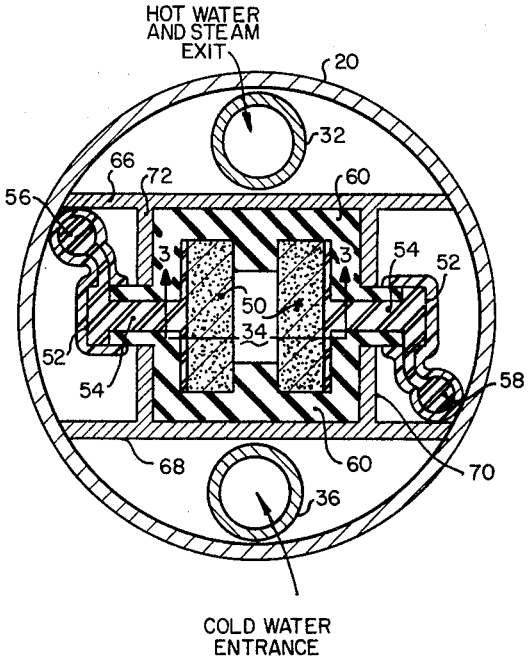
FIG. 2 is a diagrammatic, sectional view taken generally along the line 2—2 of FIG. 1, with the electrodes being rotated 90° from FIG. 1 for clarity.

Referring now more particularly to FIGS. 1 and 2 of the drawings, apparatus according to the present invention includes a flow channel arrangement 10 disposable in a reservoir R of hydrocarbons to be heated for forming a flow path for a working fluid F, which may be available water or other suitable fluid. A heating system 12 is associated with arrangement 10 for heating the working fluid F prior to discharging heated fluid F from the flow path and into reservoir R. In this manner, the substance in reservoir R is heated so as to lower the viscosity thereof and facilitate flow of the substance from reservoir R.

Flow channel arrangement 10 comprises a housing 14 having substantially parallel, planar, spaced end walls 16 and 18 connected together by a substantially cylindrical side wall 20. Housing 14 has an exterior 22 surrounding walls 16, 18 and 20, and defines within walls 16, 18, and 20 a hollow chamber 24. Arranged in chamber 24 of housing 14 is a conduit 26 communicating with the exterior 22 of housing 14 for forming the flow path for fluid F through chamber 24. Conduit 26 includes a fluid inlet 28 to chamber 24, a restricted fluid flow circuit 30 passing through chamber 24 and including three substantially parallel legs 32, 34 and 36 connected together by connector portions 38 (legs 32 and 34) and 40 (legs 34 and 36), and a fluid outlet 42 from chamber 24.

Inlet 28 and outlet 42 are respectively located in maximum distally spaced portions of the housing, with the fluid flow circuit 30 of conduit 26 forming a tortious path, substantially "S" shaped when rotated 90° from the normal vertical orientation thereof, between the inlet 28 and outlet 42. When arranged relative to an associated string S, circuit 30 forms the three substantially parallel, vertically disposed legs 32, 34, and 36.

Housing 14 is advantageously provided adjacent end wall 16 with a conventional internally V-shaped connector device 44 typically having tapered internal screw-threads and affixed on the external surface of end wall 16 for engaging a lower segment of a pipe string S disposition an associated well base having associated therewith a casing C.

Figure 3:
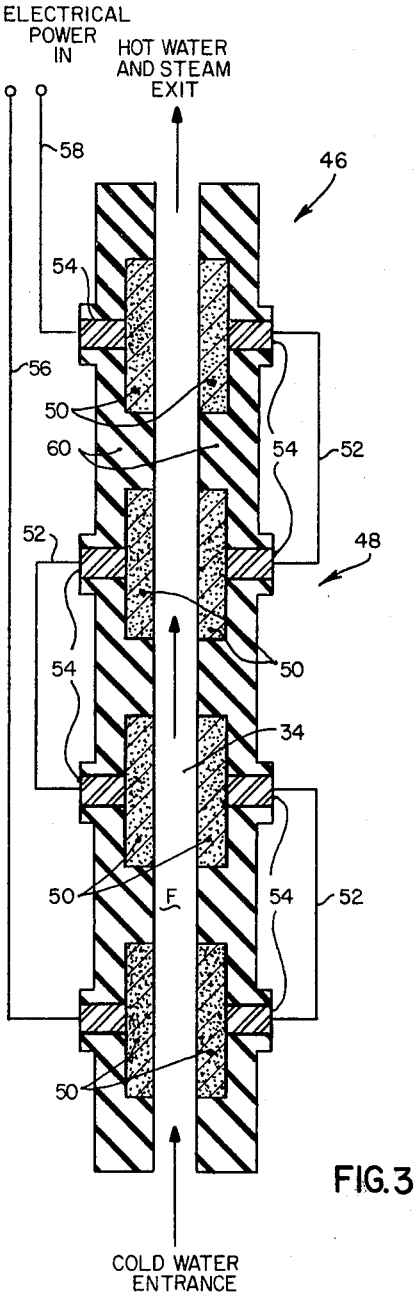
FIG. 3 is a schematic, sectional view taken generally along the line 3—3 of FIG. 2, but with some parts removed for clarity.

Referring now to FIG. 3 of the drawings, in conjunction with FIGS. 1 and 2, the construction of the heating system 12 will be described.

Heating system 12 comprises a series electrical resistance heating unit 46 including an electrical circuit 48 having at least one pair of opposed electrodes 50 arranged along and partially forming the flow path for working fluid F, specifically leg 34, with the portion of circuit 48 between electrodes 50 being completed through fluid F.

As illustrated, four pairs of electrodes 50 are provided in circuit 48, although it is to be understood the number of pairs may vary as circumstances warrant.

These pairs of electrodes 50, preferably constructed from graphite, are spaced along the flow where flow of fluid F is upward to assure continuous flow path fluid F, specifically leg 34 with each of the electrodes 50 of the pairs being electrically connected in series with all of the other electrodes 50 in the circuit 48. The advantages of this series connection will be discussed below.

Electrodes 50 are connected together in series by a plurality of conductors 52 attached to the electrodes 50 through conventional terminals 54. Leads 56 and 58 attach the endmost electrodes 50, as well as the entire circuit 48, to a suitable, known source of electrical power (not shown). The entire circuit 48, with the exception of leads 56 and 58, are advantageously embedded in a suitable, known electrical insulating material 60 (FIGS. 1 and 2), such as polytetrafluoroethylene, over about 485° F. (251.7° C.) a suitable known ceramic insulating material can be used.

The insulating material 60 is arranged in a central compartment of chamber 24 formed by a pair of substantially parallel, spaced planar bulkheads 62 and 64 arranged adjacent to but spaced from end walls 16 and 18, respectively, and by a pair of substantially parallel, spaced, planar partitions 66 and 68 extending between wall 20 of housing 14 and a pair of substantially parallel, spaced, planar partitions 70 and 72 extending between the partitions 66 and 68.

OPERATION

A unit as described above readily can be employed by arranging same at the bottom of a pipe string S in a reservoir R of hydrocarbons, or other coveted substances, having a relative high viscosity. A suitable fluid heat transfer medium, such as water, is then passed through the heating unit so as to be heated thereby, and the heated fluid is now injected either as a very hot liquid or as steam, or other vapor, into reservoir R for lowering the viscosity and facilitating the flow of the substance in the reservoir R up the bore (not shown) of a producing well.

As an alternative to using an injection well and associated producing wells arrangement, it is also possible with the present invention to use a single well in a known manner for both injection of working fluid and withdrawal of product.

The temperature of the liquid discharged from the unit according to the invention can be controlled accurately from the surface above reservoir R by variation, in a conventional manner, in the amount of electrical energy fed to the electrodes 50. It generally will be sufficient to permit the working fluid F to flow down the pipe string S to conduit 26 under the force of gravity, but the fluid F can be pumped under pressure as necessary to overcome reservoir pressure or to also control temperature at discharge by varying the rate of flow.

By way of an example, if the leads 56 and 58, 250 circular mils wire, a comparatively small diameter, and the power imput is 13,800 volts at 75 amperes, the face of electrodes 50 being at least 3/4 square inch, the resistance of the leads is only a small fraction of the circuit resistance, with over 95% of the resistance being in the gaps between electrodes 50. Thus, a crude oil being recovered can be in a solution, for example, of 6.9% oil and 93.17% water, at current prices to justify the energy input at three cents per kilowatt hour for electricity.

SUMMARY OF THE DETAILED DESCRIPTION

As readily will be understood from the above description and from the drawings, a heating device according to the present invention permits the use of a downhole heating unit is an energy efficient manner while still permitting the injection of a very hot liquid, or vapor, into a reservoir of a high viscosity substance whose viscosity is to be reduced. While a heating device according to the present invention can be used with hydrocarbons, or other suitable substances, having any specific gravity, it works best with substances having an API gravity in the range of 5–25.

It is to be understood that the above description of the present invention is capable of various changes, modifications, and adaptations, and such are intended to be included within the meaning and range of equivalents of the following claims.

I claim:

1. Apparatus for heating hydrocarbons in an underground reservoir and facilitating flow of the hydrocarbons, comprising, in combination:

(a) flow channel means disposable in a reservoir of hydrocarbons for forming a flow path for a working fluid; and (b) heating means associated with the flow channel means for heating the working fluid prior to discharging the heated working fluid from the flow path and into a reservoir of hydrocarbons to be heated, the flow channel means including, in combination:

(1) a housing having an exterior and defining a hollow chamber; and (2) conduit means arranged in the chamber of the housing and communicating with the exterior of the housing for forming the flow path, the conduit means including a fluid inlet to the chamber, a restricted fluid flow circuit through the chamber and a fluid outlet from the chamber, the housing being provided with connector means for attaching the housing to a lower end of a pipe string, the fluid inlet and fluid outlet being respectively located in the maximum spaced portions of the housing, and the fluid flow circuit of the conduit means forming a tortious path, substantially "S" shaped, between the fluid inlet and fluid outlet and arrangeable relative to an associated pipe string to form three substantially parallel, vertically disposed legs, the working fluid being a liquid, and the heating means including a pair of series connected electrodes at least partially forming a middle one of the legs, the latter being arranged forming an upwardly directed flow path means passing between the pair of electrodes for assuring that the liquid of the working fluid completely fills the associated one of the legs.

2. Apparatus for heating hydrocarbons in an underground reservoir and facilitating flow of the hydrocarbons, comprising, in combination:

(a) flow channel means disposable in a reservoir of hydrocarbons for forming a flow path for a working fluid; and (b) heating means associated with the flow channel means for heating the working fluid prior to discharging the heated working fluid from the flow path and into a reservoir of hydrocarbons to be heated, the flow channel means including, in combination: a housing having an exterior and defining a hollow chamber; and conduit means arranged in the chamber of the housing and communicating with the exterior of the housing for forming the flow path, the conduit means including a fluid inlet to the chamber, a restricted fluid flow circuit through the chamber and a fluid outlet from the chamber, the housing being provided with connector means for attaching same to a lower end of a pipe string, the fluid inlet and fluid outlet being respectively located in maximum distally spaced portions of the housing, and the fluid flow circuit of the conduit means forming a tortious path, substantially "S" shaped, between the fluid inlet and fluid outlet and arrangeable relative to an associated pipe string to form three substantially parallel, vertically disposed legs, the heating means including a series electrical resistant heating unit comprising an electrical circuit including a pair of opposed electrodes arranged along and partially forming the flow path of a working fluid, a portion of the electrical circuit between the electrodes being completed through the working fluid, the pair of electrodes being one of a plurality of pairs of opposed electrodes and spaced along the flow path of the working fluid, each of the electrodes of the pairs being electrically connected in series with all of the other electrodes in the electrical circuit.

3. Apparatus for heating hydrocarbons in an underground reservoir and facilitating flow of the hydrocarbons, comprising, in combination:

(a) flow channel means disposable in a reservoir of hydrocarbons for forming a flow path for a working fluid; and (b) heating means associated with the flow channel means for heating the working fluid prior to discharging the heated working fluid from the flow path and into a reservoir of hydrocarbons to be heated, the heating means including an electrical resistance heating unit comprising a series electrical circuit including a pair of opposed electrodes arranged along and partially forming the flow path of a working fluid, the electrical current between the electrodes being completed through the working fluid, with most of the resistance in the circuit being between the electrodes, the pair of electrodes being one of a plurality of pairs of opposed electrodes included in the electrical circuit and spaced along the flow path of the working fluid, each of the electrodes of the pairs being electrically connected in series with all of the other electrodes.

4. Apparatus as defined in claim 3 wherein the flow channel means includes, in combination:

(a) a housing having an exterior and defining a hollow chamber; and (b) conduit means arranged in the chamber of the housing and communicating with the exterior of the housing for forming the flow path, the conduit means including a fluid inlet to the chamber, a restricted fluid flow circuit through the chamber and a fluid outlet from the chamber.

5. Apparatus as defined in claim 4, wherein the housing is provided with connector means for attaching same to a lower end of a pipe string.

6. A method for facilitating the recovery from wells of hydrocarbons having relatively high viscosities, comprising the steps of:

(a) arranging a heating unit at the bottom of a pipe string in a reservoir of hydrocarbons;

(b) passing through the heating unit a fluid heat transfer medium;

(c) heating the fluid as it passes through the heating unit;

(d) injecting the heated fluid into the reservoir of hydrocarbons for reducing viscisity of the hydrocarbons;

(e) recovering by conventional techniques the reduced viscosity hydrocarbons; the step of heating the fluid including the step of passing the fluid between a plurality of pairs of series connected electrodes and using the fluid as part of an electrical circuit connecting the pairs of electrodes; and (f) maximizing a resistance in a path through the working fluid between the electrodes in relation to a total resistance of the associated circuit for causing a maximum voltage to occur in the working fluid.

7. A method as defined in claime 6, wherein the step of passing the fluid includes the step of directing the fluid upwardly between the electrodes.

* * * * *